US006371449B1

(12) United States Patent
Chamberlain

(10) Patent No.: US 6,371,449 B1
(45) Date of Patent: Apr. 16, 2002

(54) PORTABLE MOTORCYCLE HOIST

(76) Inventor: Bruce T. Chamberlain, 11326 S. Bell Ridge, Sandy, UT (US) 84094

( * ) Notice: Subject to any disclaimer, the term of this patent is extended or adjusted under 35 U.S.C. 154(b) by 0 days.

(21) Appl. No.: 09/406,912

(22) Filed: Sep. 24, 1999

(51) Int. Cl.[7] ..... B66B 1/00
(52) U.S. Cl. ..... 254/387; 254/336; 254/323; 254/10 C
(58) Field of Search ..... 254/323, 387, 254/386, 385, 359, 336, 335, 327, 326, 131, 10 B, 10 C; 187/231, 233, 235, 238, 237, 244, 251, 254, 261; 211/207

(56) References Cited

U.S. PATENT DOCUMENTS

| | | | | | |
|---|---|---|---|---|---|
| 795,147 | A | * | 7/1905 | Magoffin | 187/231 |
| 1,044,008 | A | * | 11/1912 | Boehck | 187/235 |
| 1,620,038 | A | * | 3/1927 | Remde | 187/235 |
| 1,689,259 | A | * | 10/1928 | Shepard, Jr. et al. | 187/235 |
| 1,789,025 | A | * | 1/1931 | Shepard, Jr. et al. | 187/244 |
| 2,175,041 | A | * | 10/1939 | Thumim | 187/235 |
| 2,846,018 | A | * | 8/1958 | Puckett | 187/231 |
| 2,894,605 | A | * | 5/1959 | Leavitt | 187/235 X |
| 3,385,401 | A | * | 5/1968 | Campbell et al. | 187/244 |
| 3,951,286 | A | * | 4/1976 | Horst | 187/235 |
| 4,183,423 | A | * | 1/1980 | Lewis | 187/244 |
| 4,421,209 | A | * | 12/1983 | Vermette et al. | 187/235 |
| 4,921,385 | A | * | 5/1990 | Okuno | 187/231 |
| 5,518,224 | A | * | 5/1996 | Anderson | 254/131 |
| D378,155 | S | * | 2/1997 | Bartow et al. | D34/28 |
| 5,788,016 | A | * | 8/1998 | Soulas et al. | 187/238 |
| 5,871,069 | A | * | 2/1999 | Carmitchel | 187/233 |

FOREIGN PATENT DOCUMENTS

| | | | | |
|---|---|---|---|---|
| DE | 2403181 | * | 8/1974 | 187/244 |
| FR | 1139283 | * | 6/1957 | 187/235 |
| GB | 161702 | * | 4/1921 | 187/235 |
| GB | 892613 | * | 3/1962 | 187/232 |

* cited by examiner

*Primary Examiner*—Emmanuel M. Marcelo

(57) ABSTRACT

A portable motorcycle hoist has a main frame assembly which includes a pair of vertically-oriented parallel channel beams rigidly affixed to both an upper cross brace and to a base member. The pair of channel beams provide a caged track for a trolley which is movably slidable therein between a lowermost position and an uppermost position. The trolley is fitted with a plurality of guide wheels to minimize sliding friction within the caged track. A cradle assembly, adapted to support a motorcycle beneath its engine, is attached to the trolley. Attachment may be made with welds, threaded fasteners, or other suitable means. The base member may be unitary, or it may be partially disassemblable to facilitate transport and storage. The base member may also incorporate casters to facilitate the repositioning of a supported cycle. A first main embodiment of the invention includes a first pulley mounted on the upper cross brace, a second pulley mounted on the trolley, and an electric-motor-driven winch mounted on the base member. A cable wrapped around the take-up spool of the winch is routed from the take-up spool, around the first pulley, around the second pulley, and to the upper cross brace where it is securely fastened. On-board power for the winch may be provided in the form of a battery preferably mounted on the base member. A polarity-reversing switch provides up and down control for movement of the trolley. A second main embodiment of the invention substitutes a hand-powered winch for the motor-driven winch. A third main embodiment of the invention substitutes a pneumatic cylinder for the winch and cable system. The cylinder may be powered by compressed air provided by a compressor, or it may be provided by a disposable $CO_2$ cartridge. A release valve allows the system to be depressurized in order to lower the cycle from a raised position. A fourth main embodiment of the invention substitutes a hydraulic cylinder for the pneumatic cylinder.

22 Claims, 11 Drawing Sheets

PORTABLE MOTORCYCLE HOIST

BACKGROUND OF THE INVENTION

1. Field of the Invention

This invention relates generally to portable equipment hoists and, more particularly, to hoists used to lift motorcycles so that they may be more easily serviced.

2. History of the Prior Art

A number of types of motorcycle hoists, or lifts, are in general use. Motorcycle repair shops typically have at least one hydraulic floor hoist. Such hoists are smaller versions of those used to lift automobiles. As a rule, these hoists are expensive and not easily movable. Various portable motorcycle hoists are also available. U.S. Des. Pat. No. 378,155 shows a hydraulic parallelogram motorcycle lift. Mounted on casters, it is readily movable. This lift supports the motorcycle beneath the engine, thereby freeing both wheels for ease of wheel removal. However, the parallelogram mechanism provides limited vertical travel, thereby making it difficult to work on the engine in a standing position. U.S. Pat. No. 5,518,224 shows another type of portable motorcycle lift that looks much like a small table when in the raised position. The legs are attached to a base in parallelogram fashion. The platform, when raised by means of a foot lever, attains a stable over-center position in the raised position. A locking device secures the platform in the over-center position. Like the lift of the previous patent, it lifts the motorcycle beneath the engine, thereby permitting simultaneous removal of both wheels. Also, as with the lift of the previous patent, vertical travel is limited. Other portable motorcycle hoists lift the cycle by its wheels, thereby hampering the removal of wheels and the changing and repairing of tires.

Off-road motorcycle racing is a very popular sport. Most of the participants are individuals operating with limited budgets and must tune and repair their own cycles. Tuning and repair of the motorcycle in the pits at the site of the race is usually a necessity if the bike is to be competitive. There is a need for a cycle hoist which:

(1) Is relatively inexpensive;

(2) Is simple to operate and maintain;

(3) Requires only minimal strength to raise the cycle;

(4) Is stable when the cycle is raised to the maximum height;

(3) Provides sufficient vertical displacement that the engine can be adjusted in a standing position;

(4) Provides unfettered access to both sides of the bike in the raised position;

(5) Permits removal of both wheels while in the raised position; and (6) May be readily disassembled to facilitate transport.

SUMMARY OF THE INVENTION

The present invention fills the heretofore expressed need by providing a new and novel hoist for motorcycles that is relatively inexpensive, simple to operate and maintain, requires little or no strength to raise the cycle, is stable when the cycle is in a raised position, has sufficient vertical travel so that the cycle's engine may be adjusted in a standing position, provides unfettered access to both sides of the cycle when in the fully-elevated position, permits removal of both wheels when the cycle is elevated, and may be easily and quickly disassembled to facilitate transport.

The new motorcycle hoist has a main frame assembly which includes a pair of vertically-oriented parallel channel beams rigidly affixed to both an upper cross brace and to a base member. The pair of channel beams provide a caged track for a trolley which is movably slidable therein between a lowermost position and an uppermost position. The trolley is fitted with a plurality of guide wheels to minimize sliding friction within the caged track. A cradle assembly, adapted to support a motorcycle beneath its engine, is attached to the trolley. Attachment may be made with welds, threaded fasteners, or other suitable means. The base member may be unitary, or it may be partially disassemblable to facilitate transport and storage. The base member may also incorporate casters to facilitate the repositioning of a supported cycle.

A first main embodiment of the invention includes a first pulley mounted on the upper cross brace, a second pulley mounted on the trolley, and an electric-motor-driven winch mounted on the base member. A cable wrapped around the take-up spool of the winch is routed from the takeup spool, around the first pulley, around the second pulley, and to the upper cross brace where it is securely fastened. On-board power for the winch may be provided in the form of a battery preferably mounted on the base member. A polarity-reversing switch provides up and down control for movement of the trolley.

A second main embodiment of the invention substitutes a hand-powered winch for the motor-driven winch. For the sake of convenience, the hand-powered winch is mounted on a mid-span brace which interconnects the vertical channel beams.

A third main embodiment of the invention substitutes a pneumatic cylinder for the winch and cable system. The cylinder may be powered by compressed air provided by a compressor, or it may be provided by a disposable $CO_2$ cartridge. A release valve allows the system to be depressurized in order to lower the cycle from a raised position.

A fourth main embodiment of the invention substitutes a hydraulic cylinder for the pneumatic cylinder. Operation of hydraulic cylinders is similar to the operation of pneumatic cylinders, is well known in the art, and will not be covered herein.

The invention may also be adapted to mount on the side of a trailer. For such an application, the cradle may be hinged to rotate from a horizontal position to a vertical position for storage while the trailer is being towed.

DETAILED DISCLOSURE OF THE INVENTION

The present invention is a new hoist for motorcycles that is relatively inexpensive, simple to operate and maintain, requires little or no strength to raise the cycle, is stable when the cycle is in a raised position, has sufficient vertical travel so that the cycle's engine may be adjusted in a standing position, permits removal of both wheels when the cycle is elevated, and, for all but a box trailer mounted embodiment, provides unfettered access to both sides of the cycle when in the fully-elevated position, and may be easily and quickly disassembled to facilitate transport.

Figure 1:
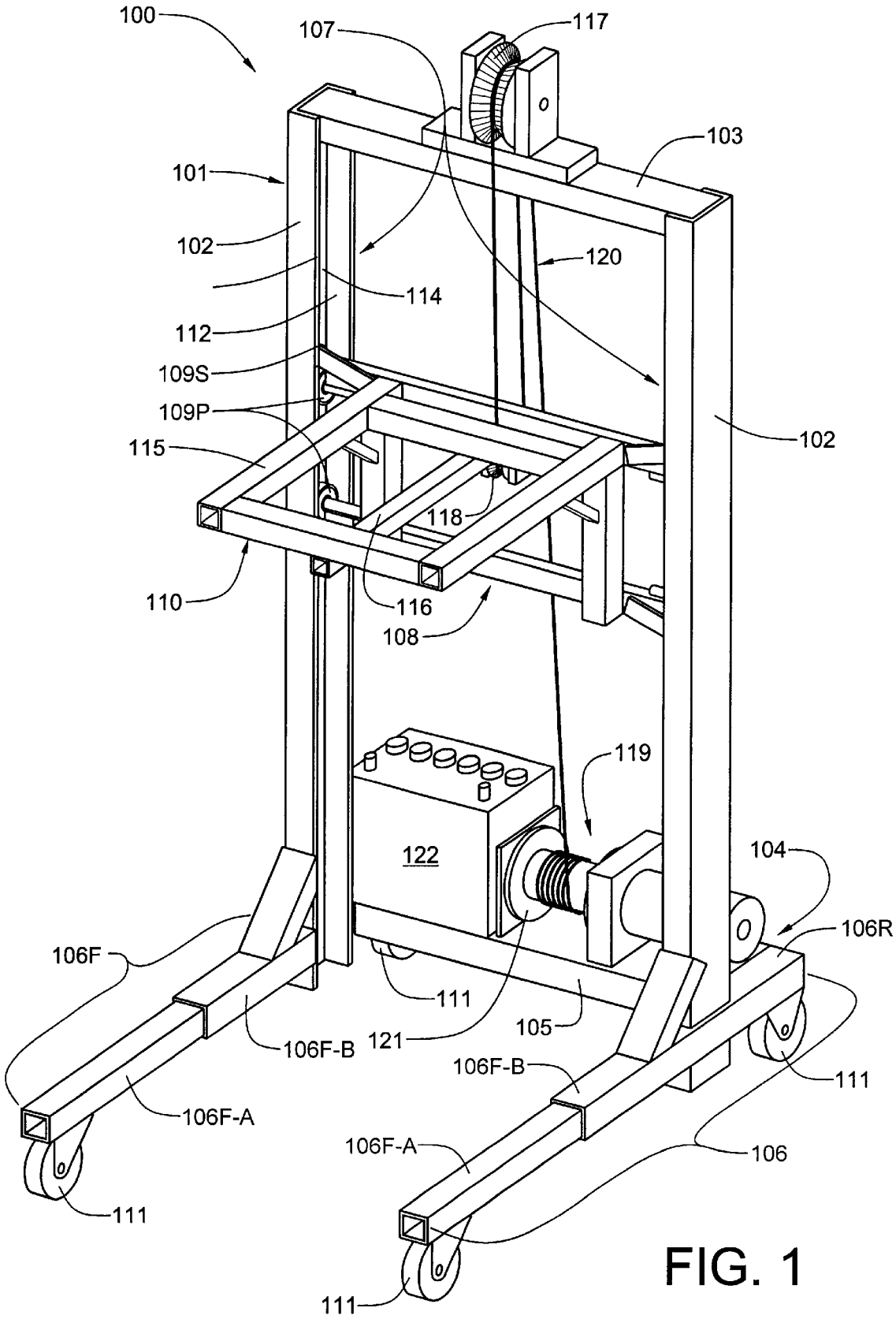
FIG. 1 is an isometric front/right-side of a first embodiment of the new motorcycle hoist.
Figure 5:
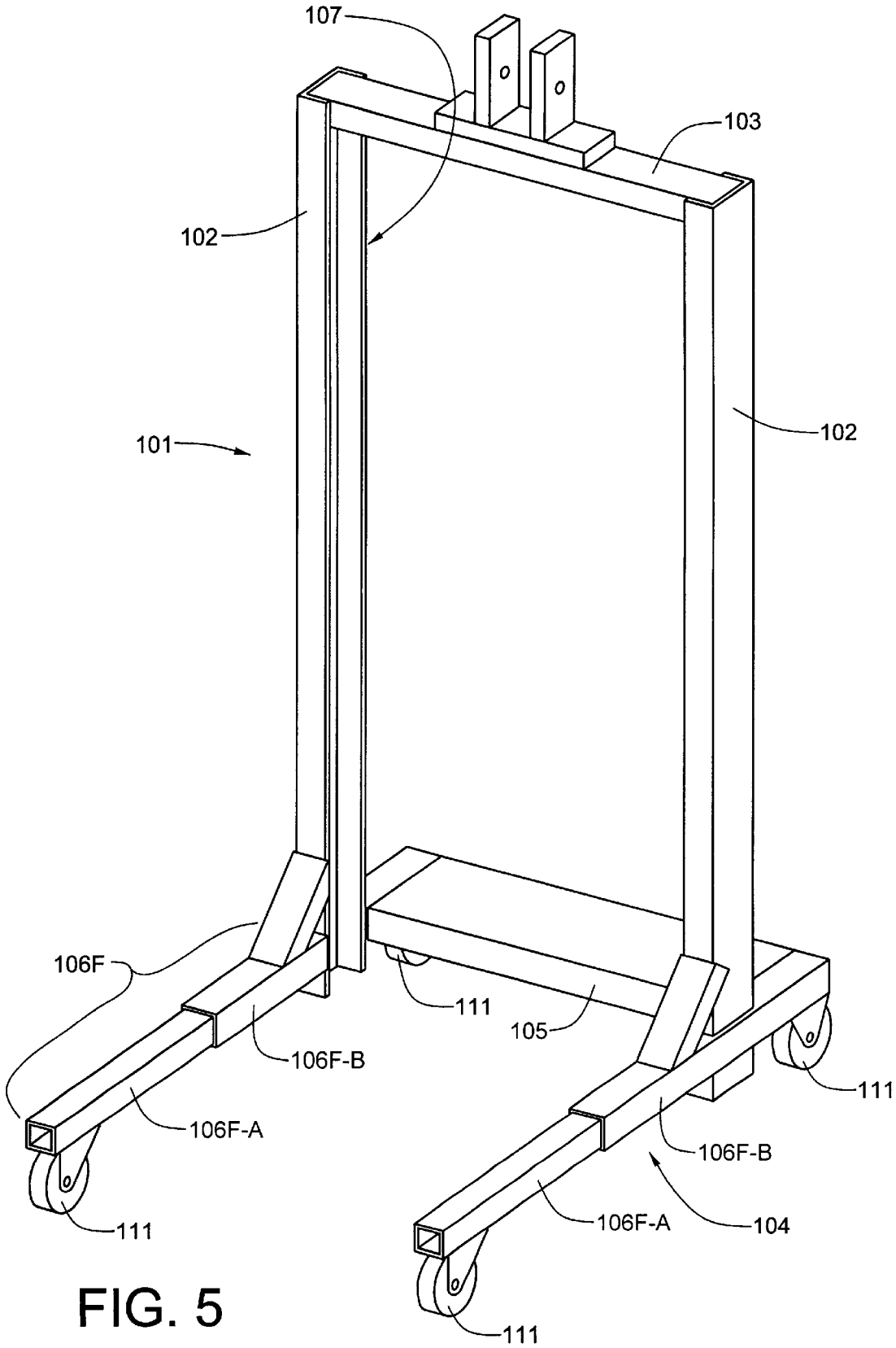
FIG. 5 is an isometric front/right-side view of the main frame assembly of the first embodiment of the new hoist.

Referring now to FIG. 1, a first embodiment of the invention incorporates a number of features elements which are common to all embodiments of the invention. The hoist 100 has a main frame assembly 101 which is shown separately in FIG. 5. The frame assembly 101 includes a pair of vertically-oriented, parallel channel beams 102 rigidly affixed to both an upper cross brace 103 and to a base member 104. The base member 104 includes a horizontal lower cross brace 105 which ties the channel beams 102 together and a horizontal support member 106 attached to each channel beam 102. Each horizontal support member 106 may extend both forward and rearward of its associated channel beam, or it may only extend rearwardly for a trailer mounted embodiment to be described hereinafter. As shown in FIGS. 1 and 5, the forward extending portion 106F of horizontal support member 106 is fabricated in two pieces. The outermost piece 106F-A slides into the innermost piece 106-B. The two pieces may be pinned or bolted together. The pair of channel beams 102 provide a caged track 107 for a trolley 108 which is movably slidable therein between a lowermost position and an uppermost position, both of which are defined by the length of the track. The trolley 108 is fitted with a plurality of guide wheels 109P and 109S, which minimize sliding friction within the caged track 107. A cradle assembly 110, adapted to support a motorcycle beneath its engine and lower frame cradle, is attached to the trolley 108. Attachment may be made with welds, threaded fasteners, or other suitable means. The horizontal support member 106 may also incorporate casters 111, which permit the cradle assembly 110 to be easily moved beneath the engine and lower frame portion of a motorcycle. In addition, the casters 111 facilitate the repositioning or moving of a supported cycle.

Figure 6:
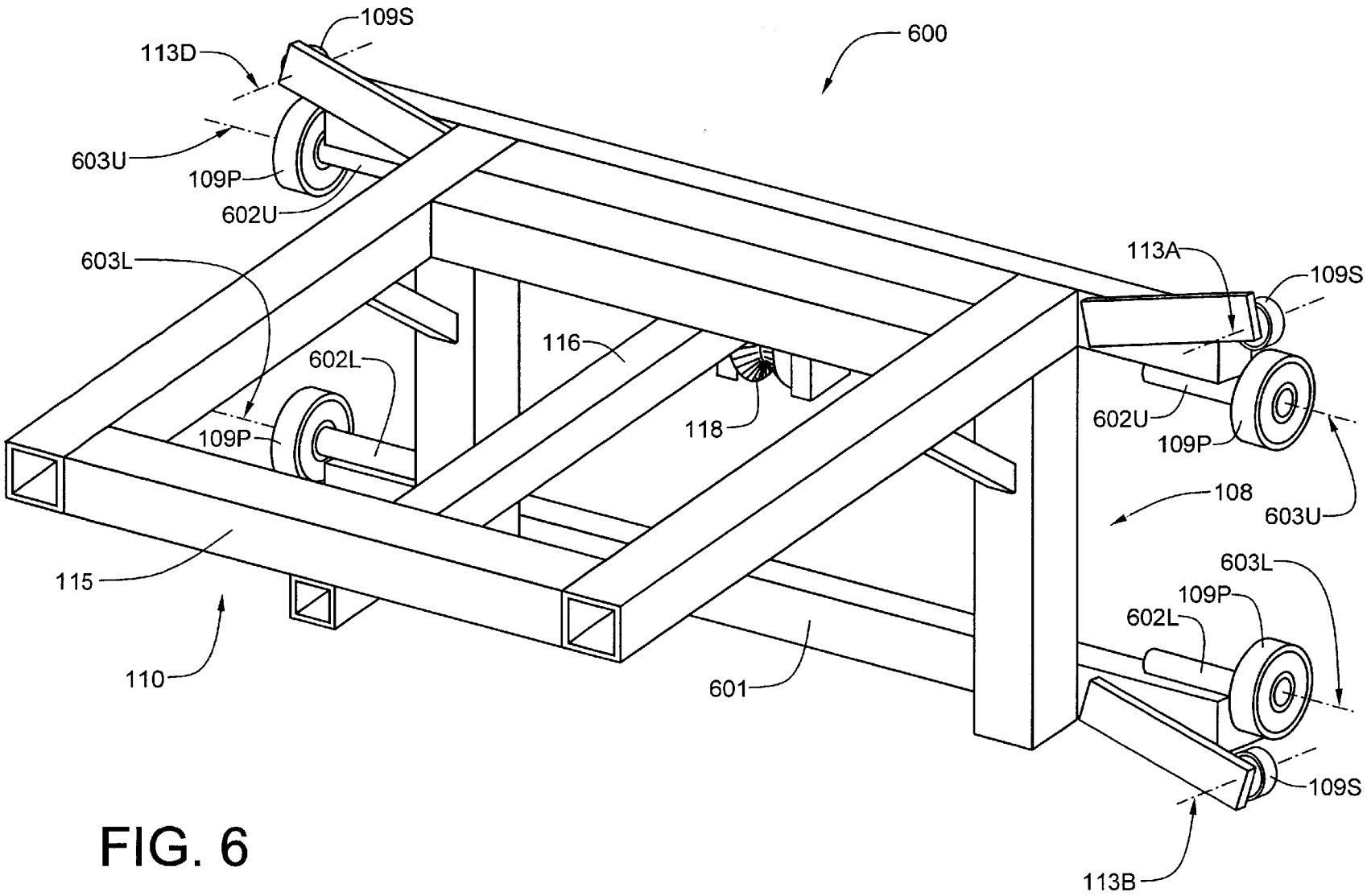
FIG. 6 is an isometric front/right-side view of the trolley and cradle assembly of the first embodiment of the new hoist.

Referring now to FIG. 6, a first embodiment of a trolley/cradle assembly 600 includes both a cradle assembly 110 and a trolley assembly 108. The trolley assembly 108 includes a rigid, more or less rectangular, structure to which four stub axles 601 are coaxially mounted in pairs. In this case, there is an upper pair 602U and a lower pair 602L. The axis passing through each pair (603U or 603L) is both perpendicular to the direction of trolley assembly travel (i.e., vertically up and down) and parallel to said upper cross brace 103. Both axes 603U and 603L are spaced apart and parallel to one another. On each stub axle 601 is mounted a primary guide wheel 109P. The primary guide wheels 109P of each stub axle pair 602U and 602L ride against parallel interior surfaces 112 of different channel beams 102. The trolley assembly 108 further includes a secondary guide wheel 109S mounted adjacent each primary guide wheel 109P on an axis 113A, 113B, 113C or 113D that is both perpendicular both to the upper cross brace 103 and perpendicular to the axes of said stub axle axes. Each of the secondary guide wheels 109S rides against an interior surface 114 of a channel beam 102 that is perpendicular to the parallel interior surfaces 112. It will be noted that the cradle assembly 110 includes a horizontally disposed rectangular frame 115 and an auxiliary support member 116 attached to the underside of the rectangular frame 115. The auxiliary support member 116 bisects the rectangular frame 115 and is perpendicular to the upper and lower cross braces (103 and 105, respectively). For a preferred embodiment of the invention, each of the primary and secondary guide wheels is a sealed ball-bearing assembly. The foregoing description covers all embodiments of the invention.

Referring once again to FIG. 1, a first main embodiment of the invention includes a first pulley 117 mounted on the upper cross brace 103, a second pulley 118 mounted on the trolley assembly 108, and an electric-motor-driven winch 119 mounted on the lower cross brace 105. One end of a cable 120 is wrapped around the take-up spool 121 of the winch 119. The free end of the cable 120 is routed from the take-up spool 121, around the first pulley 117, around the second pulley 118, and to the upper cross brace 103, where it is securely fastened. On-board power for the winch 119 may be provided in the form of a battery 122, which is preferably mounted on the lower cross brace 105. A polarity-reversing switch (shown in FIG. 9) provides up and down control for movement of the trolley assembly 108 and the attached cradle assembly.

Figure 2:
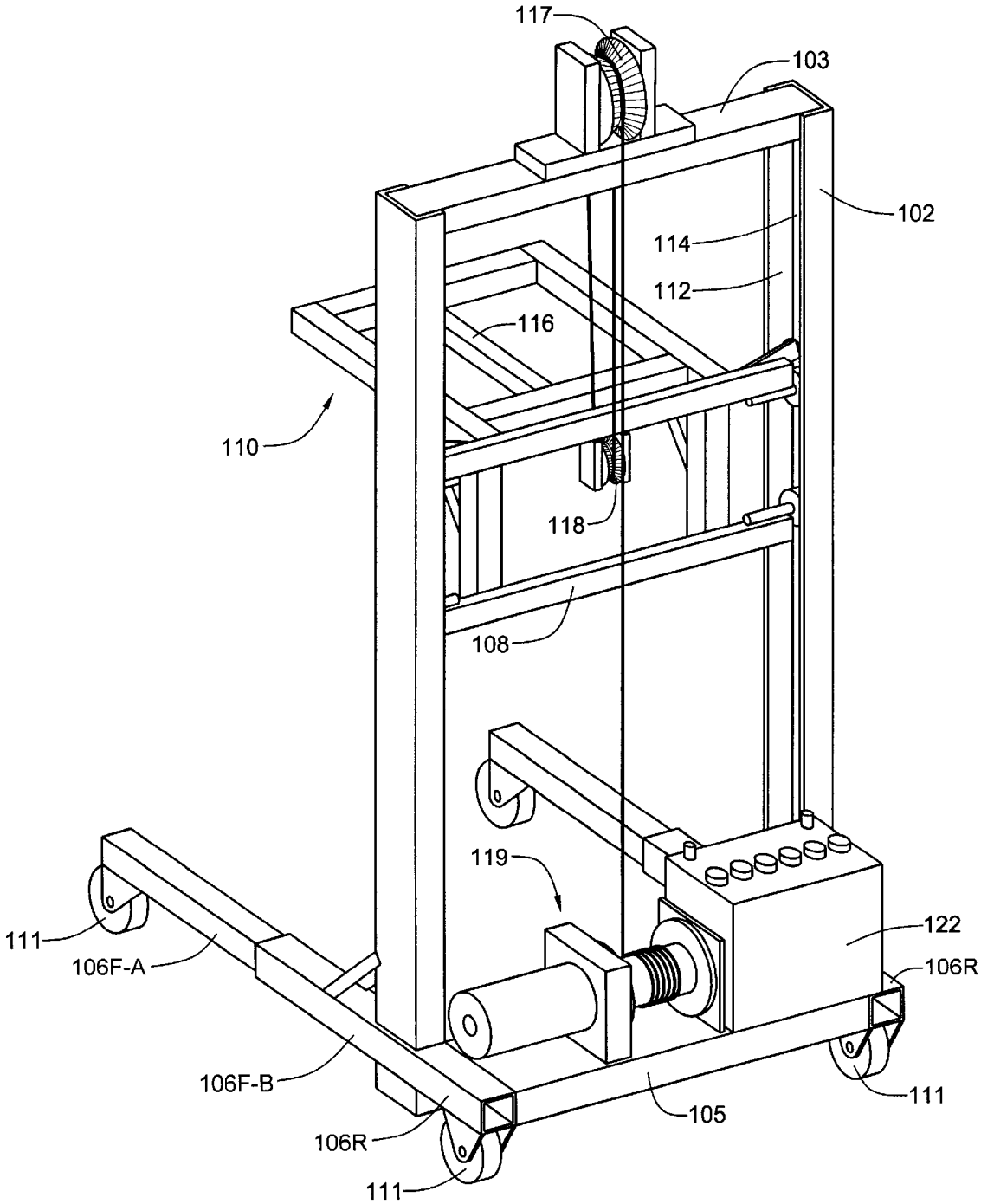
FIG. 2 is an isometric rear/right-side view of the first embodiment of the new hoist.
Figure 3:
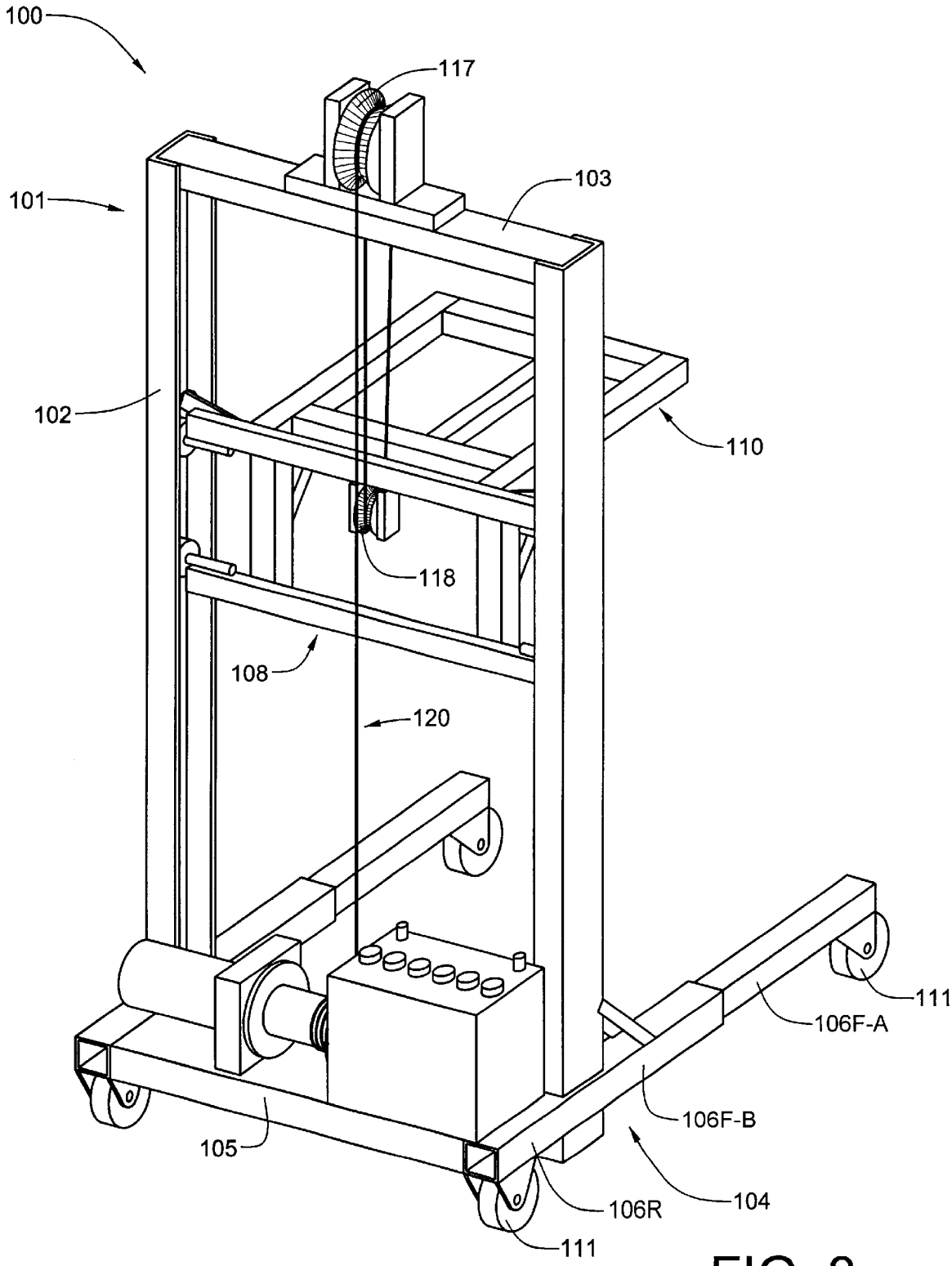
FIG. 3 is an isometric rear/left-side view of the first embodiment of the new hoist.

FIG. 2 provides additional detail of the mounting of the second pulley 118 and clearly shows the routing of the cable 120. FIG. 3 provides a different perspective from the other side.

Figure 4:
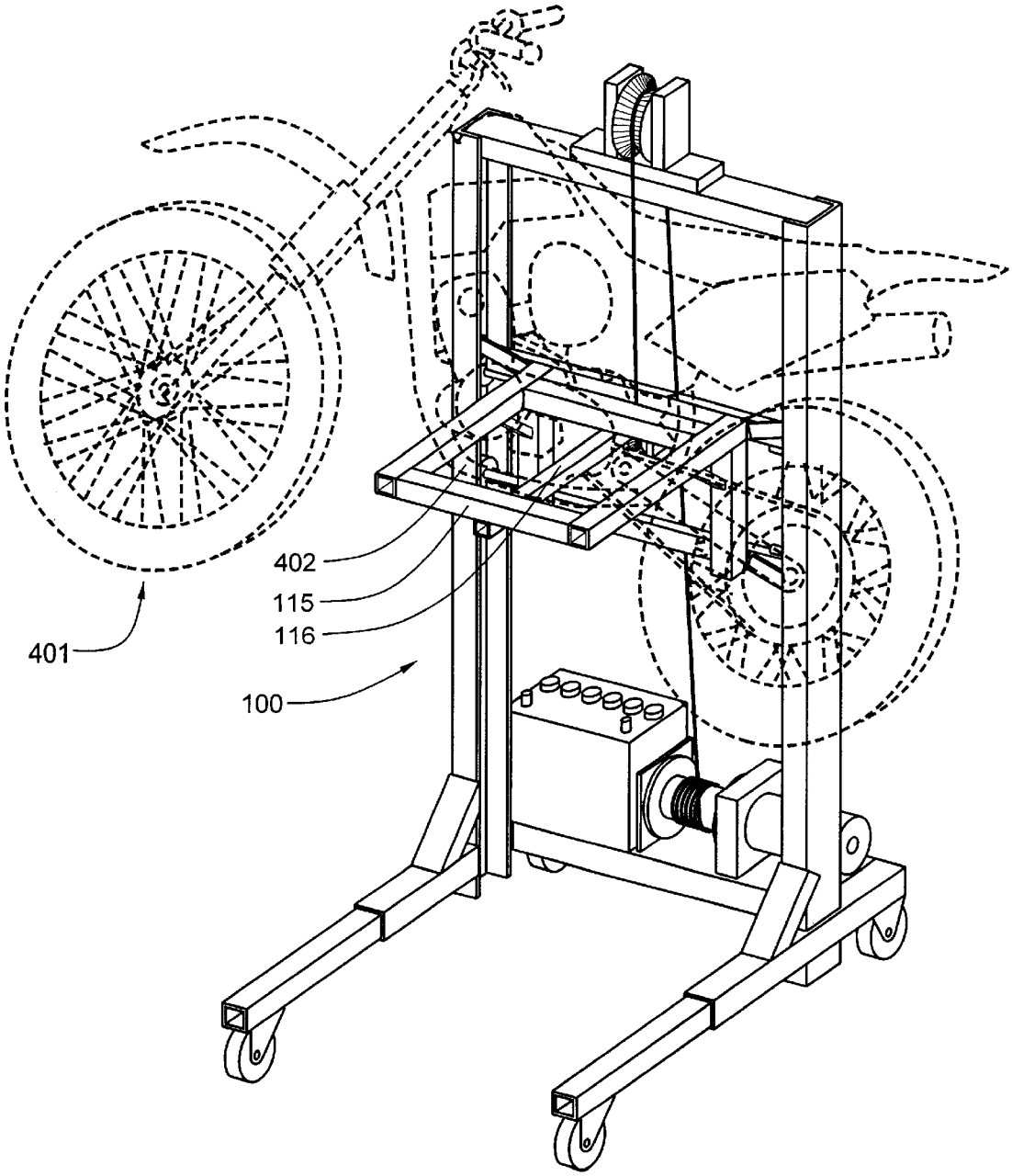
FIG. 4 is a view of the new hoist as shown in FIG. 1 with a motocross cycle in outline form supported on the cradle thereof.

Referring now to FIG. 4, the motorcycle hoist of FIG. 1 is shown with a motorcycle 401 of the motocross type supported by the cradle assembly 110. The auxiliary support member 116 facilitates rocking the motorcycle so that the front and rear wheels may be differentially elevated. It will be noted that the lower frame portion of the motorcycle, also known as the engine cradle, is supported primarily by the rectangular frame 115 of the cradle assembly 110. The auxiliary support member 116 gives additional support.

Figure 7:
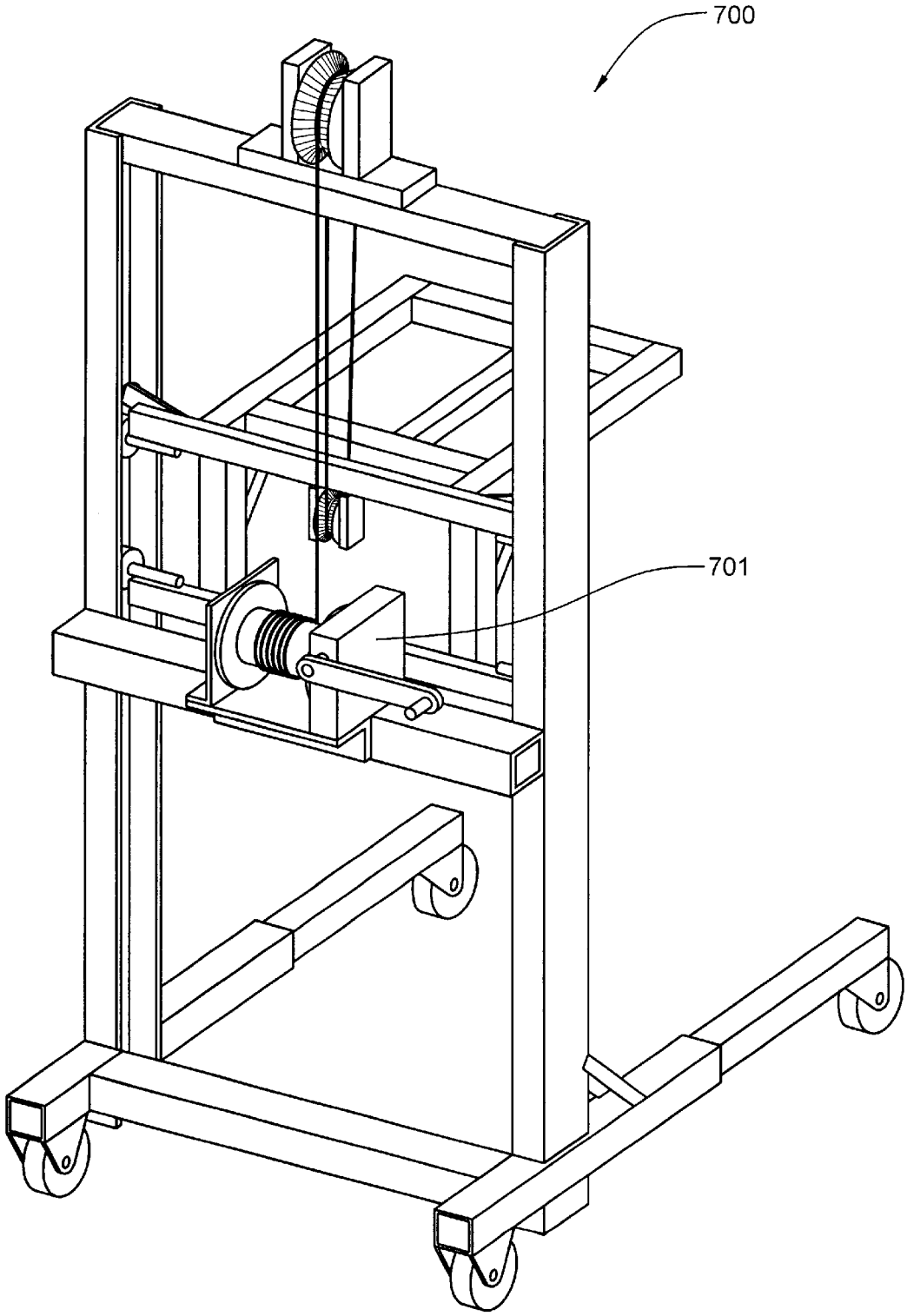
FIG. 7 is an isometric rear/right-side view of a second embodiment of the new hoist.

Referring now to FIG. 7, a motorcycle hoist 700 similar to that of hoist 100 of FIG. 1, is shown. The primary difference is that the motor-driven winch 119 is replaced by a hand-powered winch 701 that, for the sake of convenience, is mounted to a center frame brace 702.

Figure 8:
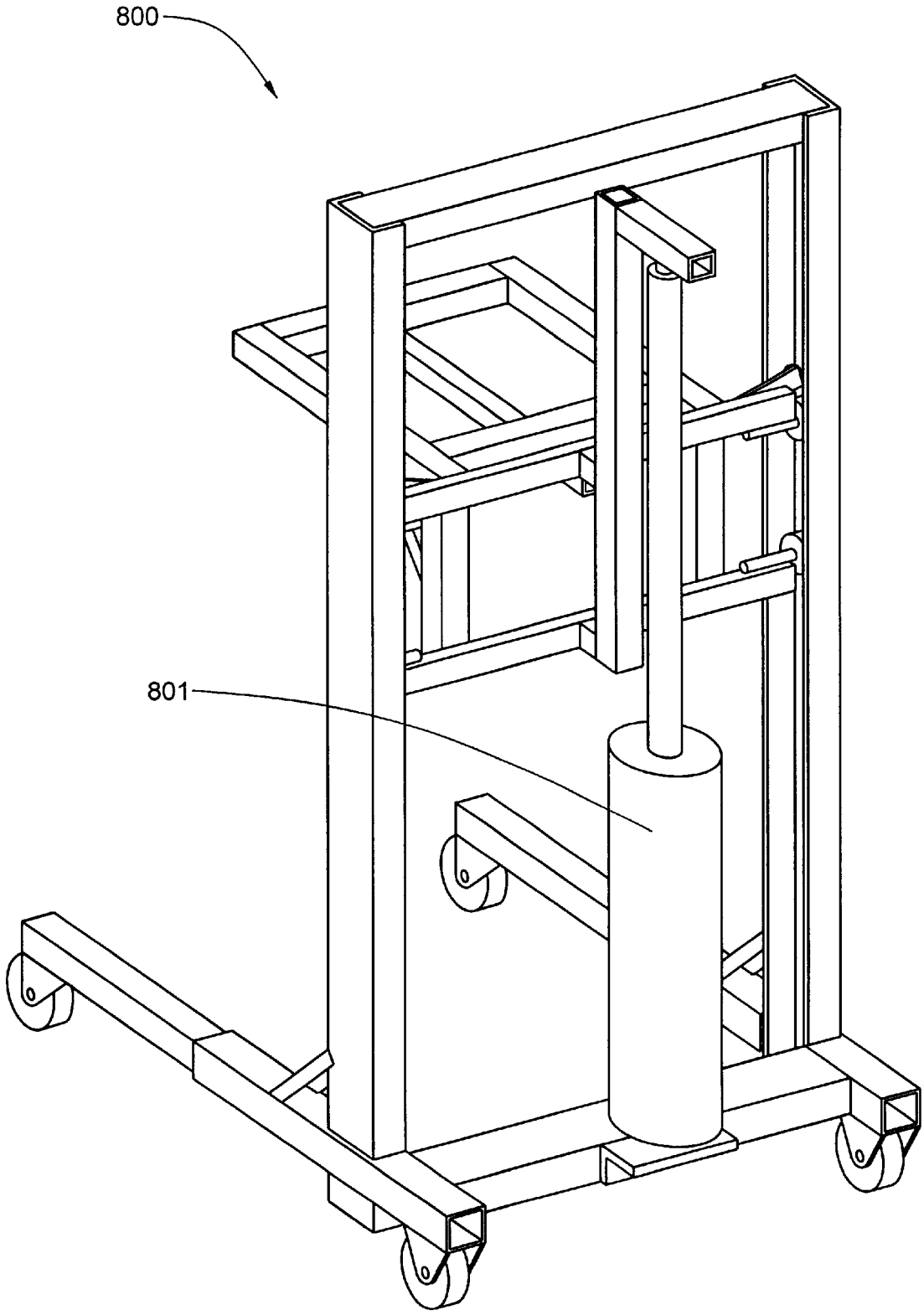
FIG. 8 is an isometric rear/right-side view of a third or fourth embodiment of the new hoist.

Referring now to FIG. 8, a third main embodiment of the new motorcycle hoist is shown. This hoist 800 differs from that of hoist 100 of FIG. 1 in that the power driven winch 119 has been replaced by a pressurizable cylinder 801 having an extensible lift rod 802. The cylinder 801 may be of the type that is pressurized with a compressed gas or the type that is pressurized with a hydraulic fluid. The hoses required to implement functionality of the cylinder and lift rod are not shown and are considered to be of ordinary skill in the art for pneumatic and hydraulic devices.

Figure 9:
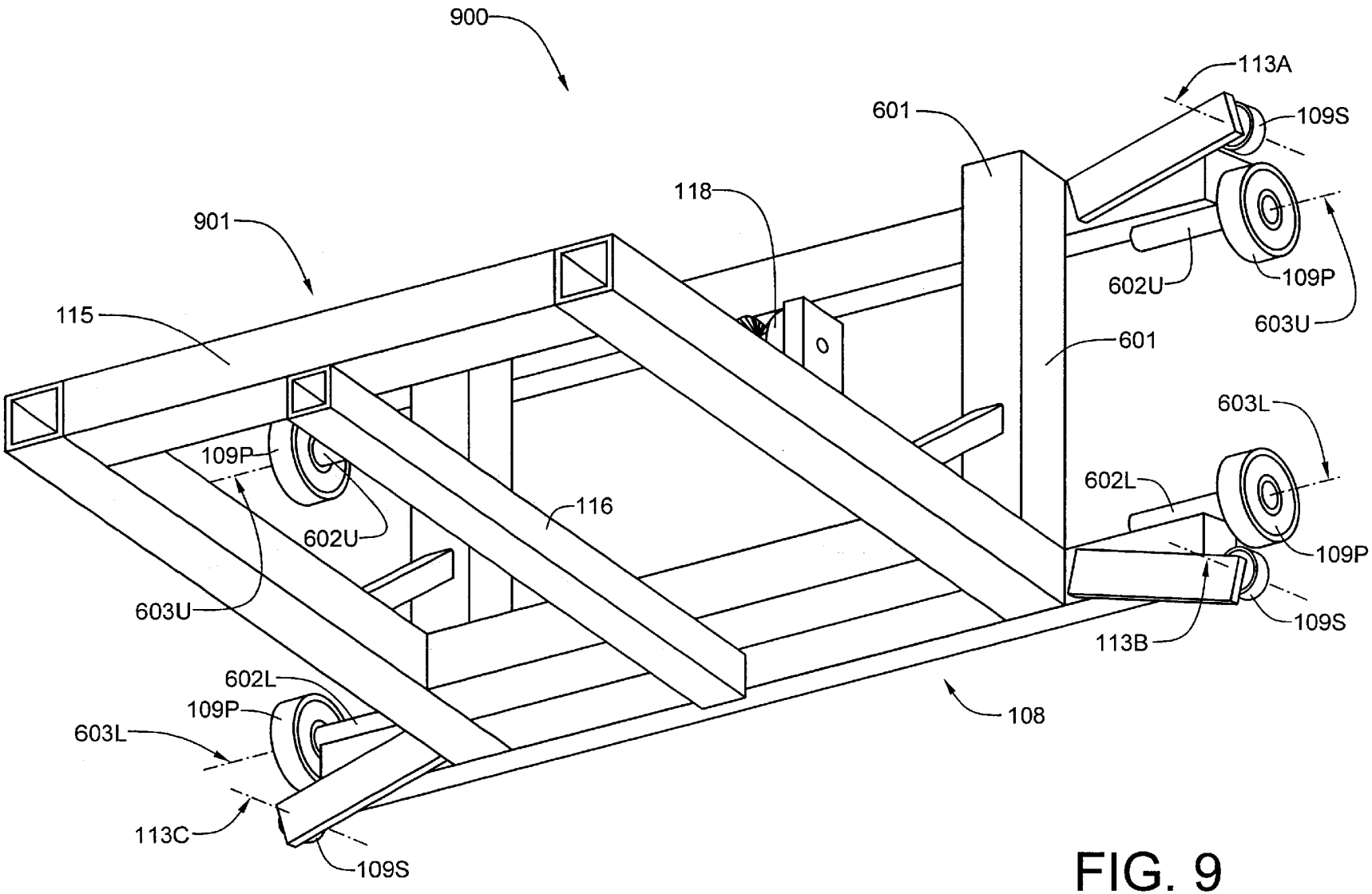
FIG. 9 is an isometric view of a cradle assembly modified for use on a trailer mounted hoist.

FIG. 9 shows a preferred circuit 900 for providing functionality to the hoist 100 of FIG. 1. The circuit 1100 is powered by a battery 1101 and protection from short circuits is provided by a circuit breaker BR1. The circuit 1100 also utilizes a first solenoid 1102A in conjunction with a second solenoid 902B to provide bidirectional movement of the motor M, which turns the take-up spool 121. When the solenoid contacts 1103 are in the up position, rotation of the motor M is normal. When in the down position, rotation of the motor M is reversed. A control switch 1104 provides reversable switching of the solenoids 1102A and 1102B. A first limit switch LIMIT UP provides protection against the motor M overheating by cutting power at the point of maximum upward travel of the trolley assembly 108. A second limit switch LIMIT DOWN cuts power at the point of maximum downward travel of the trolley assembly 108, thereby preventing the trolley from leaving the track 107.

Figure 10:
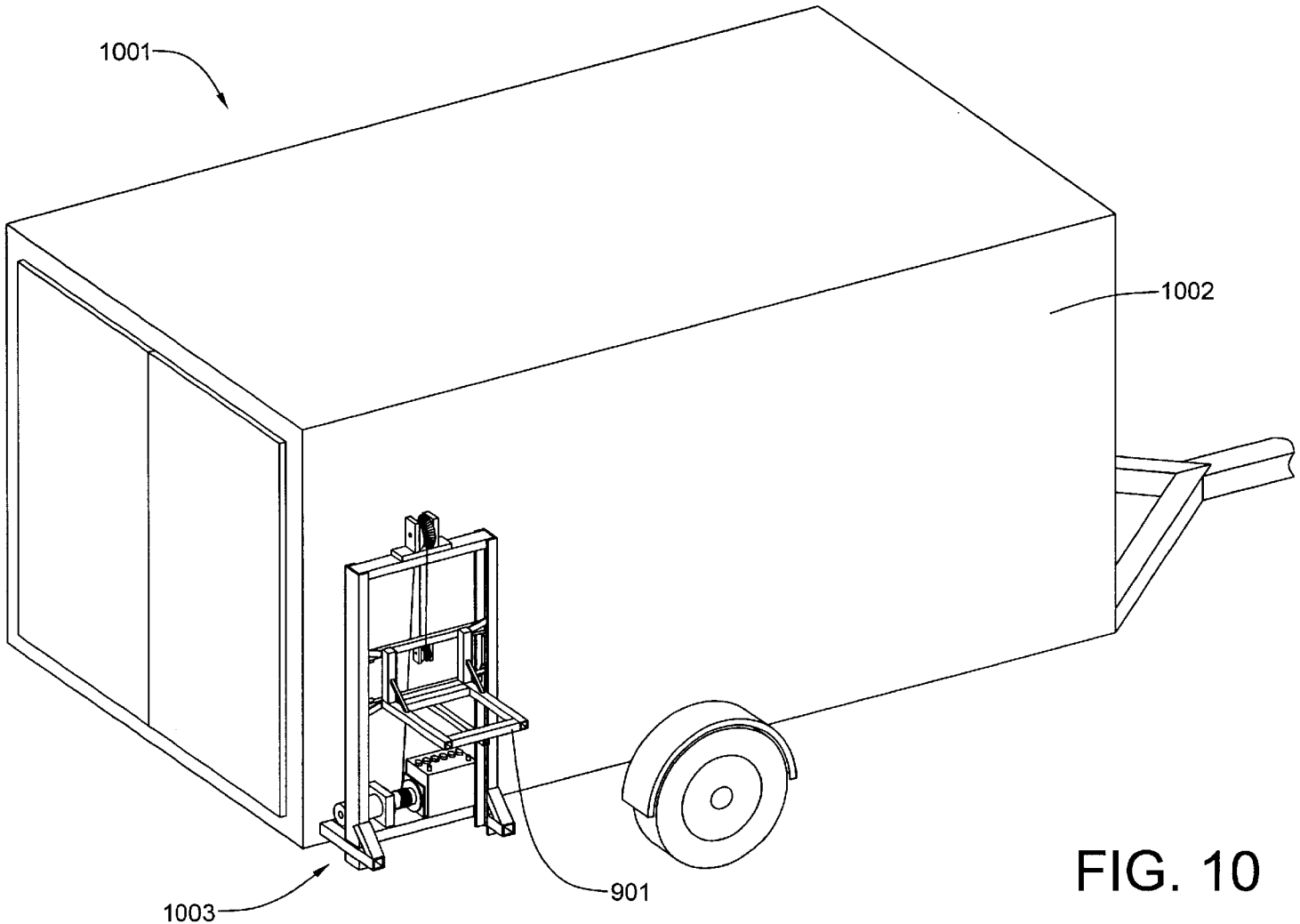
FIG. 10 is an isometric view of a trailer to which is attached the new hoist.

Referring now to FIG. 10, the hoist 100 FIG. 1 has been adapted for mounting on the side of a box trailer 1001. It is cantilever mounted to the outer sidewall 1002 with a top bracket attached to either the channel beams 102 or the upper cross brace 103. A rearward extension of the horizontal support member 106 may be mounted to the underside of the trailer box.

Figure 11:
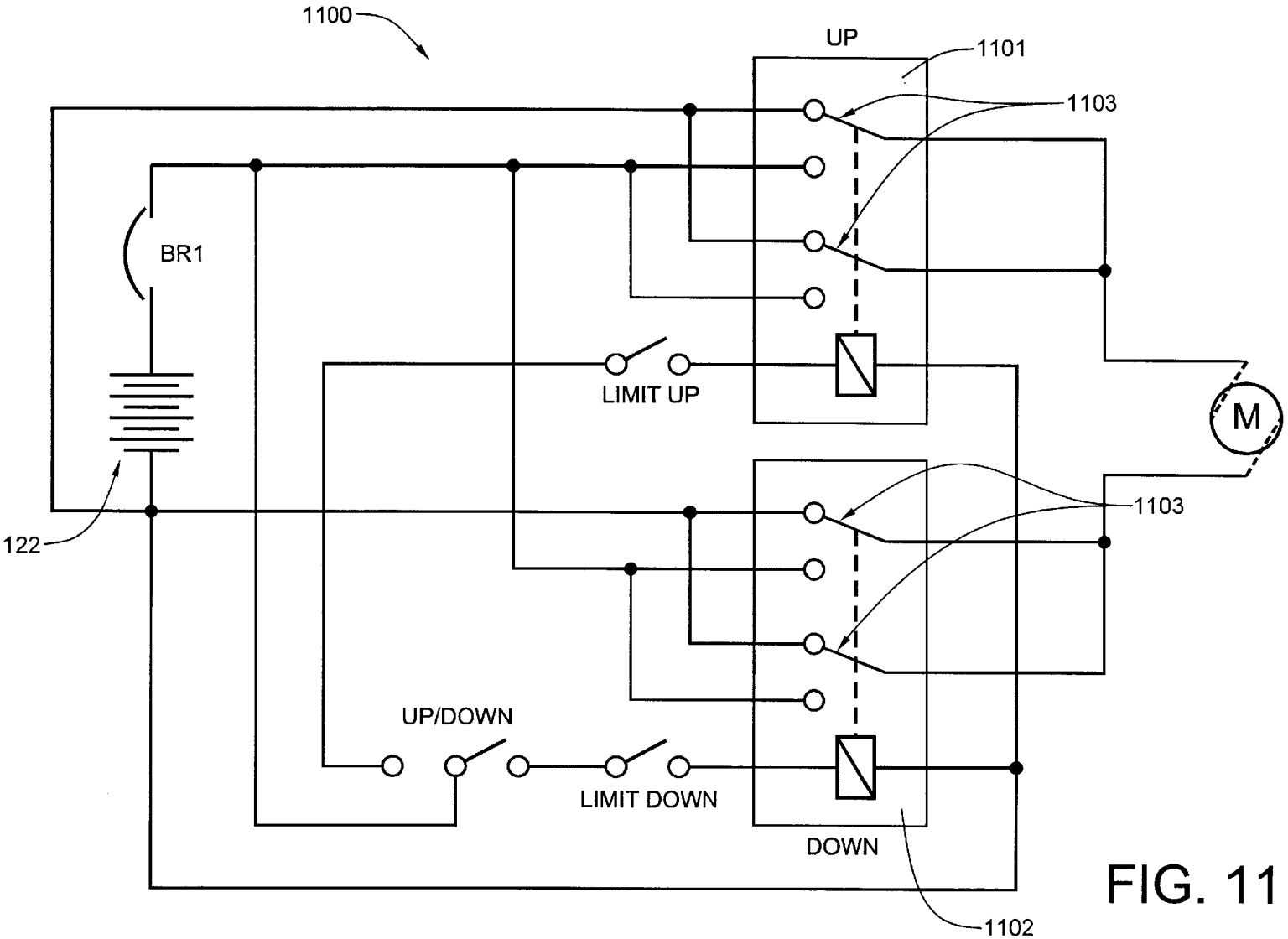
FIG. 11 is a diagram of the circuitry used to control the motorized winch of the first embodiment of the invention.

Referring now to FIG. 6, for a second embodiment of a trolley/cradle assembly 900, the cradle assembly 901 has been inverted as compared with the cradle assembly 110 of FIG. 6. The pulley 118 and auxiliary support tube 116 have been repositioned, as well. Referring now to FIG. 11, the cradle assembly has been modified by basically turning it upside down, and repositioning both the auxiliary support tube and the second pulley. The modifications are made so that when used on the box trailer-mounted hoist, the cradle assembly is low enough to maneuver the motorcycle thereover without having to lift the cycle by hand.

Although only several embodiments of the present invention have been disclosed herein, it will be obvious to those having ordinary skill in the art that changes and modifications may be made thereto without departing from the scope and spirit of the invention as hereinafter claimed.

What is claimed is:

1. A motorcycle hoist comprising:

a main frame assembly having a pair of vertically-oriented, spaced-apart, parallel channel beams rigidly affixed to both an upper cross brace and to a base member, each channel beam having a channel with opposed and parallel first and second inner surfaces, both of which are contiguous with a third inner surface that is both perpendicular to the first and second surfaces faces and parallel and facing the third inner surface of the other channel beam and directly, said pair of channel beams forming a caged track;

a trolley movably slidable within said caged track between a lowermost position and an uppermost position, said trolley including a rigid structure to which four stub axles are coaxially mounted in pairs, the axis passing through each pair being perpendicular to both the direction of trolley travel and parallel to said upper cross brace, both axes being spaced apart and parallel to one another, each stub axle having mounted thereon a primary guide wheel, the guide wheels of each stub axle pair riding against first and second interior surfaces of different channel beans, said trolley further including a secondary guide wheel mounted adjacent each primary guide wheel on an axis perpendicular both to the upper cross brace and to the stub axle axes, each of said secondary guide wheels riding against one of said inner surfaces, said guide wheels acting to minimize sliding friction within the caged track;

a cradle assembly attachable to said trolley, said cradle assembly adapted to support a motorcycle beneath its engine; and a device for raising and lowering said trolley within the caged track.

2. The motorcycle hoist of claim 1, wherein said base member incorporates casters to facilitate sliding the hoist beneath the engine of a motorcycle.

3. The motorcycle hoist of claim 1, wherein said device for raising and lowering said trolley comprises a winch attached to said main frame assembly, said winch having a take-up spool.

4. The motorcycle hoist of claim 1, wherein said device for raising and lowering comprises a pressurizable cylinder containing a slidable piston, said cylinder and piston being coupled between said main frame assembly and said trolley.

5. The motorcycle hoist of claim 1, wherein said guide wheels are sealed ball bearing assemblies.

6. A motorcycle hoist comprising:

a main frame assembly having a pair of vertically-oriented parallel channel beams rigidly affixed to both an upper cross brace and to a base member, said pair of channel beams forming a caged track;

a trolley movably slidable within said caged track between a lowermost position and an uppermost position, said trolley including a rigid structure to which four stub axles are coaxially mounted in pairs, the axis passing through each pair being both perpendicular to the direction of trolley travel and parallel to said upper cross brace, both axes being spaced apart and parallel to one another, each stub axle having mounted thereon a primary guide wheel, the guide wheels of each stub axle pair riding against parallel interior surfaces of different channel beams, said trolley further including a secondary guide wheel mounted adjacent each primary guide wheel on an axis perpendicular to the upper cross brace and perpendicular to the axes of said stub axle axes, each of said secondary guide wheels riding against an interior surface of a channel beam that is perpendicular to the parallel interior surfaces;

a cradle assembly attachable to said trolley, said cradle assembly adapted to support a motorcycle beneath its engine; and a device for raising and lowering said trolley within the caged track.

7. The motorcycle hoist of claim 6, wherein said cradle assembly comprises:

a horizontally disposed rectangular frame; and an auxiliary support member attached to the underside of said rectangular frame, said member bisecting said rectangular frame and being perpendicular to said cross brace.

8. The motorcycle hoist of claim 6, wherein said base member comprises:

a horizontal lower cross brace which interconnects the channel beams;

an horizontal support member attached to each channel beam, each horizontal support member extending both forward and rearward of its associated channel beam.

9. The motorcycle hoist of claim 8, wherein each horizontal support member incorporates a caster at each end thereof to facilitate sliding the hoist beneath the engine of a motorcycle.

10. The motorcycle hoist of claim 8, wherein the forward extending portion of each horizontal support member comprises a pair of segments, which may be reversably dismantled to facilitate storage of the hoist.

11. The motorcycle hoist of claim 6, wherein said device for raising and lowering said trolley comprises a winch attached to said main frame assembly.

12. The motorcycle hoist of claim 6, wherein said device for raising and lowering comprises a pneumatic cylinder coupled between said main frame assembly and said trolley.

13. The motorcycle hoist of claim 6, wherein said device for raising and lowering comprises a hydraulic cylinder coupled between said main frame assembly and said trolley.

14. The motorcycle hoist of claim 6, wherein said hoist is adapted for mounting on an outer wall of an enclosed box trailer.

15. A motorcycle hoist comprising:

a main frame assembly having a pair of vertically-oriented, spaced-apart, parallel channel beams rigidly affixed to both an upper cross brace and to a base member, said pair of channel beams forming a caged track;

a trolley movably slidable within said caged track between a lowermost position and an uppermost position, said trolley including a rigid structure to which at least four stub axles are mounted such that the axes thereof are coplanar and both perpendicular to the direction of trolley travel and parallel to said upper cross brace, each stub axle having mounted thereon a primary guide wheel, at least two primary guide wheels riding against parallel interior surfaces of each channel beam, said trolley further including at least four secondary guide wheels, each of which is rotatable about an axis perpendicular to the plane in which the axes of said stub axles lie, at least two of said secondary guide wheels riding against an interior surface of each channel beam that is perpendicular to the parallel interior surfaces;

a cradle assembly attachable to said trolley, said cradle assembly adapted to support a motorcycle beneath its engine; and a device for raising and lowering said trolley within the caged track.

16. The motorcycle hoist of claim 15, wherein said cradle assembly comprises:

a horizontally disposed rectangular frame; and an auxiliary support member attached to an underside of said rectangular frame, said member bisecting said rectangular frame and being perpendicular to said cross brace.

17. The motorcycle hoist of claim 15, wherein said base member comprises:

a horizontal lower cross brace which interconnects said channel beams;

an horizontal support member attached to each channel beam, each horizontal support member extending both forward and rearward of its associated channel beam.

18. The motorcycle hoist of claim 17, wherein each horizontal support member incorporates a caster at each end thereof to facilitate sliding the hoist beneath the engine of a motorcycle.

19. The motorcycle hoist of claim 17, wherein a forward extending portion of each horizontal support member comprises a pair of segments, which may be reversably dismantled to facilitate storage of the hoist.

20. The motorcycle hoist of claim 15, wherein said device for raising and lowering said trolley comprises a winch attached to said main frame assembly.

21. The motorcycle hoist of claim 15, wherein said device for raising and lowering comprises a pressurizable cylinder containing a slidable piston, said cylinder and piston being coupled between said main frame assembly and said trolley.

22. The motorcycle hoist of claim 15, wherein said hoist is adapted for mounting on an outer wall of an enclosed box trailer.

* * * * *